US010428841B2

(12) United States Patent
Knoell et al.

(10) Patent No.: US 10,428,841 B2
(45) Date of Patent: Oct. 1, 2019

(54) ELECTROHYDRAULIC SYSTEM FOR USE UNDER WATER, AND PROCESS VALVE HAVING AN ELECTROHYDRAULIC SYSTEM OF SAID TYPE

(71) Applicant: Robert Bosch GmbH, Stuttgart (DE)

(72) Inventors: Reiner Knoell, Burgsinn (DE); Alexandre Orth, Waldbuettelbrunn (DE); Alexander Koertgen, Bonn (DE); Gerard Swagten, Boxtel (NL)

(73) Assignee: Robert Bosch GmbH, Stuttgart (DE)

( * ) Notice: Subject to any disclaimer, the term of this patent is extended or adjusted under 35 U.S.C. 154(b) by 206 days.

(21) Appl. No.: 15/502,734

(22) PCT Filed: Jul. 21, 2015

(86) PCT No.: PCT/EP2015/066629
§ 371 (c)(1),
(2) Date: Feb. 8, 2017

(87) PCT Pub. No.: WO2016/023712
PCT Pub. Date: Feb. 18, 2016

(65) Prior Publication Data

US 2017/0227021 A1 Aug. 10, 2017

(30) Foreign Application Priority Data

Aug. 13, 2014 (DE) ..... 10 2014 215 997

(51) Int. Cl.
*F15B 1/26* (2006.01)
*E21B 33/035* (2006.01)
(Continued)

(52) U.S. Cl.
CPC ..... *F15B 1/265* (2013.01); *E21B 33/0355* (2013.01); *E21B 34/04* (2013.01); *F15B 15/18* (2013.01); *F15B 21/006* (2013.01)

(58) Field of Classification Search
CPC ..... E21B 33/0355; E21B 34/04; F15B 1/021; F15B 15/1461; F15B 15/18; F15B 21/006
See application file for complete search history.

(56) References Cited

U.S. PATENT DOCUMENTS 2,461,037 A * 2/1949 Crumble ..... B62M 1/10 138/31
2,671,317 A * 3/1954 Heintzelman ..... F15B 15/18 251/25

(Continued)

FOREIGN PATENT DOCUMENTS

DE 19931208 A1 * 1/2001 ..... F15B 1/025
DE 102011119181 A1 * 5/2013 ..... F15B 15/1461

(Continued)

OTHER PUBLICATIONS

International Search Report corresponding to PCT Application No. PCT/EP2015/066629, dated Oct. 27, 2015 (German and English language document) (7 pages).

*Primary Examiner* — F Daniel Lopez
*Assistant Examiner* — Matthew Wiblin
(74) *Attorney, Agent, or Firm* — Maginot, Moore & Beck LLP

(57) ABSTRACT

An electrohydraulic system for use at great water depths includes a vessel, a hydrostatic machine, and an electric machine. The vessel has an interior space configured to form a volume that is closed off with respect to the surroundings and that accommodates a hydraulic pressure fluid. The vessel includes a compensation piston configured to subject the hydraulic pressure fluid in the interior space to at least approximately the pressure prevailing in the surroundings. The hydrostatic machine is configured to be operated as a pump. The electric machine is mechanically coupled to the hydrostatic machine and operates as an electric motor in order to operate the hydrostatic machine as a pump. The (Continued)

hydrostatic machine and the electric machine are arranged in the interior space of the vessel. The compact electrohydraulic system fits on existing installations and on new installations. The electrohydraulic system also includes a compact process valve.

17 Claims, 2 Drawing Sheets

(51) Int. Cl.

| | |
|---|---|
| ***F15B 15/18*** | (2006.01) |
| ***F15B 21/00*** | (2006.01) |
| ***E21B 34/04*** | (2006.01) |

(56) References Cited

U.S. PATENT DOCUMENTS

| | | | | | |
|---|---|---|---|---|---|
| 3,572,032 | A * | 3/1971 | Terry | B63C 11/52 | 60/398 |
| 3,677,001 | A * | 7/1972 | Childers | E21B 33/0355 | 137/236.1 |
| 3,764,233 | A | 10/1973 | Strickland | | |
| 3,933,338 | A | 1/1976 | Herd et al. | | |
| 4,054,155 | A | 10/1977 | Hill | | |
| 4,500,066 | A * | 2/1985 | Trassl | F16K 31/124 | 251/26 |
| 4,869,288 | A * | 9/1989 | Toshio | F16L 55/07 | 137/494 |
| 5,144,801 | A | 9/1992 | Scanderbeg et al. | | |
| 5,363,650 | A | 11/1994 | Bodycoat et al. | | |
| 6,339,886 | B1 * | 1/2002 | Reinhardt | E21B 47/08 | 33/302 |
| 6,662,559 | B1 | 12/2003 | Cook | | |
| 6,974,115 | B2 * | 12/2005 | Silva | F01C 21/10 | 251/30.01 |
| 8,083,499 | B1 * | 12/2011 | Krug | E21B 43/126 | 417/390 |
| 8,596,608 | B2 | 12/2013 | Grimseth et al. | | |
| 2011/0142632 | A1 * | 6/2011 | Stoltz | F16H 61/4043 | 416/36 |
| 2013/0333366 | A1 * | 12/2013 | Grethel | F15B 7/006 | 60/327 |
| 2013/0333894 | A1 * | 12/2013 | Geiger | E21B 33/0355 | 166/336 |

FOREIGN PATENT DOCUMENTS

| | | | | |
|---|---|---|---|---|
| EP | 0 040 732 | A1 | 12/1981 | |
| FR | 1085114 | A * | 1/1955 | F02M 59/00 |
| GB | 1 426 622 | | 3/1976 | |
| GB | 2 063 425 | A | 6/1981 | |
| WO | 2014/074708 | A1 | 5/2014 | |

* cited by examiner

ELECTROHYDRAULIC SYSTEM FOR USE UNDER WATER, AND PROCESS VALVE HAVING AN ELECTROHYDRAULIC SYSTEM OF SAID TYPE

This application is a 35 U.S.C. § 371 National Stage Application of PCT/EP2015/066629, filed on Jul. 21, 2015, which claims the benefit of priority to Serial No. DE 10 2014 215 997.0, filed on Aug. 13, 2014 in Germany, the disclosures of which are incorporated herein by reference in their entirety.

BACKGROUND

The disclosure relates to an electrohydraulic system for use under water, in particular at great water depths. The system comprises a vessel which has an interior space which is provided for forming a volume that is closed off in relation to the environment and is provided for receiving a hydraulic fluid, and a compensation piston, so as to pressurize the hydraulic fluid in the interior space to at least approximately that pressure that prevails in the environment. The system furthermore comprises a hydrostatic machine that is operable at least as a pump, and an electro-machine that is mechanically coupled to the hydrostatic machine and operates as an electric motor for operating the hydrostatic machine as a pump, and a hydro-cylinder, of which the interior is subdivided into a cylinder chamber proximal to the piston rod, and into a cylinder chamber distal to the piston rod by way of a piston to which a piston rod is connected, wherein in order for the piston rod to be moved in a first direction, in particular in order to deploy the piston rod, pressurized fluid is infeedable from the hydrostatic machine operating as a pump to a first cylinder chamber, in particular to the cylinder chamber distal to the piston rod.

Electrohydraulic systems of this type are used in the context of crude oil and natural gas exploration, of mining, of natural-science research, or of infrastructure projects above all for moving an element under water at water depths down to several thousand meters. In this way, process valves by way of which the volumetric flow of the medium to be conveyed may be regulated or shut off are located at great depths of the ocean in the case of crude-oil or natural-gas well installations, for example.

An electrohydraulic system having the features listed above is known from U.S. Pat. No. 3,933,338, for example. This system comprises a hydro-cylinder of which the cylinder housing sits on the housing of a process valve, and which comprises a piston and a piston rod that unilaterally protrudes from the piston and by way of which a process-valve stem of the process valve may be moved. The piston subdivides the interior of the cylinder housing into a cylinder space distal to the piston rod, and into a cylinder space proximal to the piston rod. A helical spring which impinges the piston in the sense of closing the process valve is accommodated in the cylinder space proximal to the piston rod. The known system furthermore comprises a vessel of the interior space that is filled with a pressurized fluid at one point is separated from the environment by a movable compensation piston. The compensation piston on a first face is impinged by the pressure in the interior space of the vessel, and on a second face which is of identical size to the first face and is directed so as to oppose the latter is impinged by the ambient pressure such that the same pressure prevails in the interior space as in the environment. The cylinder space proximal to the piston rod is in permanent fluidic communication with the interior space of the vessel. The cylinder space distal to the piston rod, depending on the position of a hydraulic valve, is either connected to a pump or to the interior space of the vessel and to the cylinder space proximal to the piston rod. Thus, pressurized fluid may be conveyed by the pump into the cylinder space distal to the piston rod in the one position of the valve, in order for the piston rod to be deployed and for the process valve to be opened. Upon switching of the hydraulic valve, the piston rod is retracted by a spring force such that the process valve closes.

The disclosure is based on the object of achieving a compact electrohydraulic system which may be installed in existing as well as new equipment, on the one hand, and to enable a process valve of compact construction including an electrohydraulic system, on the other hand.

SUMMARY

The object is achieved by an electrohydraulic system which comprises a vessel which has an interior space which is provided for forming a volume that is closed off in relation to the environment and is provided for receiving a hydraulic fluid, and a compensation piston, so as to pressurize the hydraulic fluid in the interior space to at least approximately that pressure that prevails in the environment, a hydrostatic machine that is operable at least as a pump, and an electro-machine that is mechanically coupled to the hydrostatic machine and operates as an electric motor for operating the hydrostatic machine as a pump, wherein the hydrostatic machine and the electro-machine are disposed in the interior space of the vessel.

A compact unit which is easy to handle and which may readily be fastened to any equipment is obtained by accommodating the hydrostatic machine and the electric machine in the vessel. Complex piping may be largely dispensed with. A hydro-cylinder by way of which the process valve is activated may likewise be accommodated in and fastened to the vessel. However, it is also possible for the hydro-cylinder to be fastened to the equipment. In this instance, a respective opening on the vessel and a respective free space in the interior space of the vessel have to be made available in which the hydro-cylinder is received if and when the vessel is connected to the equipment, for example to the process-valve housing of a process valve.

A substantial advantage of the solution according to the disclosure also lies in that the individual components are protected in a simple manner from aggression by seawater by way of the compact embodiment of the electrohydraulic system, such that a long service life is enabled. The risk of hydraulic fluid leaking into the seawater is reduced, since there are not many individual components that have to be sealed in relation to water. A complex supply of hydraulic fluid to the depths is avoided. Only an electric cable is required.

An electrohydraulic system according to the disclosure may be advantageously designed in various ways.

It is thus preferable for the hydrostatic machine which hereunder will be referred to as hydro-machine for short to be also operable as a hydro-motor and for the electro-machine to be also operable as a generator. In this instance, pressurized fluid may be displaced from the cylinder chamber distal to the piston rod by way of the hydro-machine when the piston rod of the hydro-cylinder is being retracted.

Entirely different types of hydro-machines may be used. For example, the hydro-machine may be one having a constant swept volume. In the case of each revolution of a drive shaft, such a hydro-machine always conveys or inducts the same amount of pressurized fluid. The hydro-machine is preferably readjustable in terms of the swept volume thereof. In this instance, highly dynamic regulating of the position of the hydro-cylinder and thus of that part that is moved by the hydro-cylinder is possible in particular in conjunction with an electro-machine that is regulatable in terms of the revolution speed thereof.

If and when the hydro-machine is readjustable from positive swept volumes via a zero position in which the swept volume is zero to negative swept volumes, said hydro-machine is thus operable as a pump and as a motor in the same rotation direction and by way of the same pressure connector.

In one particularly preferred design embodiment of an electrohydraulic system according to the disclosure, the connection between a pressure connector of the hydro-machine and a consumer line which is provided for supplying a pressurized space of a hydraulic consumer, for example for supplying a cylinder chamber distal to the piston rod of a hydro-cylinder, is controllable by way of a valve that is located in the interior space of the vessel in such a manner that the connection in a resting position which the valves assumes under the effect of a spring is open, and in a switching position which the valve assumes under the effect of an electric actuator is blocked at least in the direction from the cylinder chamber distal to the piston rod to the hydrostatic machine. The valve is advantageously configured as a seat valve such that in the blocked position there is no or only very minor leakage via the valve, and such that the hydro-machine and the electro-machine may be out of operation.

It is advantageous for a hydro-accumulator having a pressurized-fluid space to be accommodated in the interior space of the vessel, said hydro-accumulator being infeedable pressurized fluid from the hydro-machine in the operation thereof as a pump, and pressurized fluid being infeedable from said hydro-accumulator to a consumer line via which a pressurized space of a hydraulic consumer, for example the cylinder space proximal to the piston rod of a hydro-cylinder, is impingible by pressure. The cylinder chamber proximal to the piston rod may thus be impinged with accumulator pressure such that in the case of the power supply being outed or switched off the piston rod is also retracted by being impinged with accumulator pressure. A particularly short reaction time in response to an outage of the power supply is obtained in the case of a conjoint use of the spring assembly and of the hydro-accumulator. Also, two redundant possibilities for moving the hydro-cylinder to a resting position are provided by the spring assembly and by the hydro-accumulator.

The connection between the consumer line and the hydro-accumulator is advantageously controllable by way of a valve that is located in the interior space of the vessel in such a manner that the connection in a resting position which the valve assumes under the effect of a spring is open, and in a switching position which the valve assumes under the effect of an electric actuator is blocked at least in the direction from the hydro-accumulator to the consumer line.

The consumer line and thus the cylinder chamber proximal to the piston rod is advantageously in fluidic communication with the interior space of the vessel in normal operation. This connection may be interrupted by a valve if and when the second cylinder chamber is to be impinged with accumulator pressure. The connection via the valve is controllable in such a manner that the connection in a resting position which the valve assumes under the effect of a spring is blocked at least in the direction from the second cylinder chamber to the interior space, and in a switching position which the valves assumes under the effect of an electric actuator is open.

The electrohydraulic system advantageously also comprises a hydro-cylinder, of which the interior is subdivided into a cylinder chamber proximal to the piston rod, and into a cylinder chamber distal to the piston rod by way of a piston to which a piston rod is connected, wherein in order for the piston rod to be moved in a first direction, in particular in order to deploy the piston rod, pressurized fluid is infeedable from the hydrostatic machine operating as a pump to a first cylinder chamber, in particular to the cylinder chamber distal to the piston rod. The hydro-cylinder is preferably likewise received in the interior space of the vessel. On account thereof, the risk of an external leakage is further reduced. In principle, however, it is also possible for the hydro-cylinder for activating the process valve to be located outside the vessel, and to be fastened to the equipment independently of the latter. The vessel in this instance may be fastened to the hydro-cylinder or to the equipment.

The hydro-cylinder preferably comprises a mechanical spring assembly by which the piston is impinged in a second direction that is counter to the first direction. The piston rod may be retraced by such a spring as soon as the power supply to the system has been interrupted.

The pressure in the pressurized-fluid space of the hydro-accumulator during normal operation is higher than the pressure in the interior space of the vessel and is thus higher than the pressure in the second cylinder chamber and is lower than the pressure that usually bears on the process valve in the conveying line. It is therefore favorable for two seals that surround the piston rod to be disposed in an axially sequential manner in a cylinder head of the hydro-cylinder that guides the piston rod, and for the region between the two seals to be in fluidic communication with the pressurized-fluid space of the hydro-accumulator. On account thereof, the pressure differential during normal operation across the one seal is only of the same magnitude as the differential between the pressure on the process valve and the accumulator pressure, such that the leakage between the two systems is minor.

The compensation piston, in a manner known per se, on a first face is impingeable by the pressure in the interior space of the vessel, and on a second face, which is of identical size to the first face and is directed so as to oppose the latter, is impingeable by the ambient pressure. The compensation piston now is advantageously also impinged by a spring assembly which generates a force that is directed in the same direction as the force which is generated by the ambient pressure. On account thereof, the pressure in the interior space of the vessel is elevated in relation to the ambient pressure by the pressure equivalent of the spring force. It is ensured that no salt water enters the vessel. The pressure in the vessel may be between 0.1 bar and 2 bar, preferably between 0.5 bar and 2 bar higher than the ambient pressure, for example.

By detecting one or a plurality of positions of the compensation piston by a position sensor or by a plurality of position sensors it may be determined whether the amount of the pressurized fluid in the interior space of the vessel increases or decreases by leakage over the operating time. It has to be considered herein, however, that the volume available to the pressurized fluid in the interior space of the vessel during retraction and deployment of the piston rod slightly varies according to the cross section of the piston rod and the path of the latter. This has repercussions on the position of the compensation piston. A leakage is thus only present once the terminal positions of the compensation piston come to lie outside a specific range.

The compensation piston may be formed by a dimensionally stable disk or else by a movable membrane that is clamp-fitted at the periphery thereof.

The pressure connector of the hydro-machine is advantageously secured by a pressure-limiting valve.

The disclosure also relates to a device for disposing under water and for controlling a volumetric flow of a gaseous or liquid medium, having a process valve having a process-valve housing, having a process-valve stem by way of which the volumetric flow is controllable, and having a hydro-cylinder which is fastened to the process-valve housing and by way of which the process-valve stem is movable, and having an electrohydraulic system according to the disclosure, wherein the vessel is fastened in a sealed manner to the process-valve housing.

Advantageously, a hydro-cylinder that is present protrudes into the interior space of the vessel through an opening in the latter.

BRIEF DESCRIPTION OF THE DRAWINGS

An exemplary embodiment of a device according to the disclosure, having an electrohydraulic system, of which the vessel is fastened to a process valve is illustrated in the drawings. The disclosure will now be explained in more detail by means of these drawings. In the drawings.

DETAILED DESCRIPTION

Figure 1:
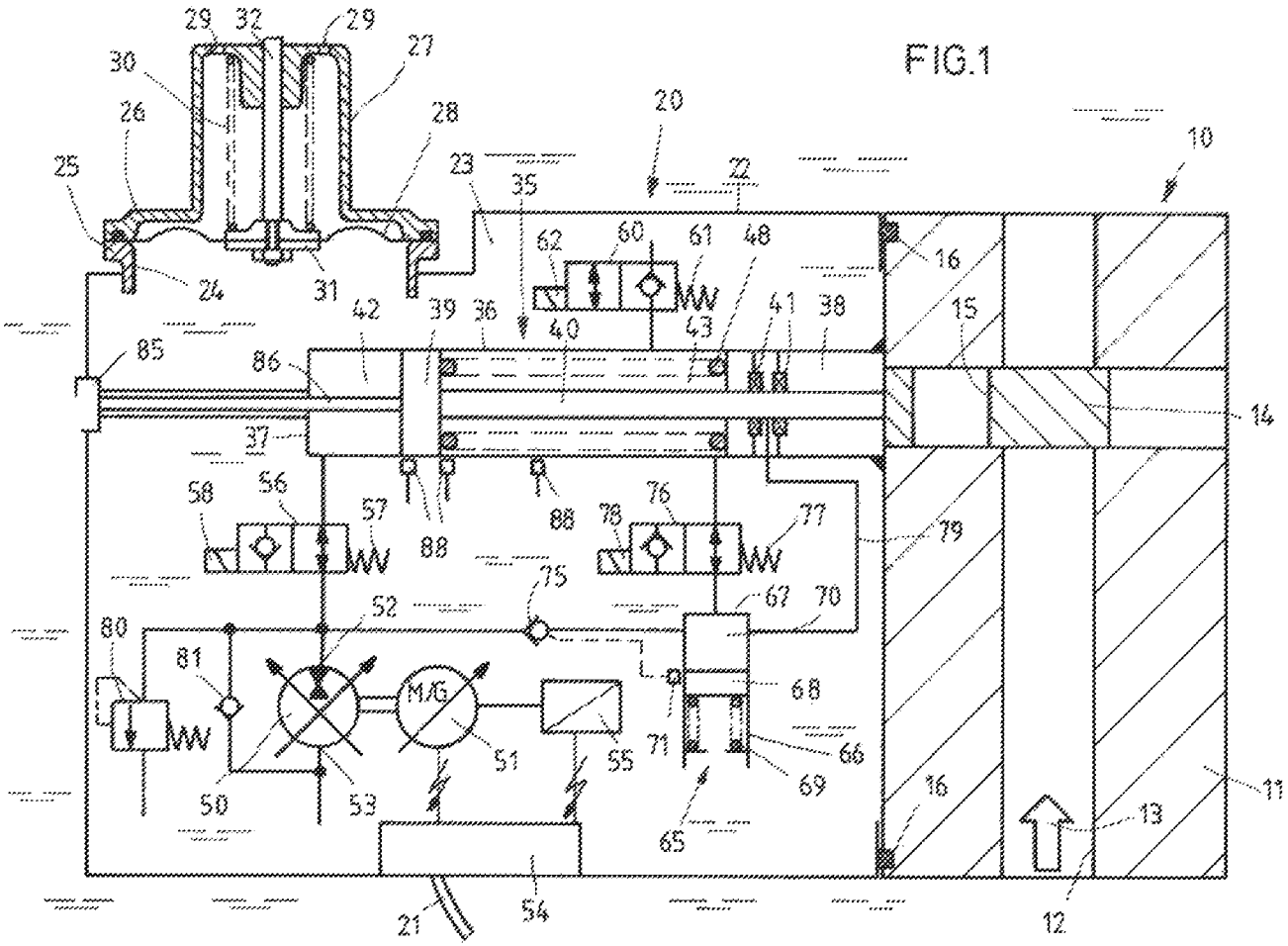
FIG. 1 schematically shows the device in the case of a closed process valve.

The exemplary embodiment of a device according to the disclosure, shown in the figures, has a process valve 10 having a process-valve housing 11 through which a process-valve duct 12 is routed, the latter at the mouths thereof continuing through pipes (not shown), and a gaseous or liquid medium flowing therein from the seabed to a part of a drilling rig that protrudes from the sea, or to a drilling ship. The flow direction is to indicated by the arrow 13.

A cavity that traverses the process-valve duct 12 and in which a process-valve stem 14 having a throughflow opening 15 is movable transversely to the longitudinal direction of the process-valve duct 12 is configured in the process-valve housing 11. In the state as per FIG. 1, the process-valve duct 12 and the throughflow opening 15 in the process-valve stem 14 are not mutually superimposed. The process valve is thus closed. In the state as per FIG. 2, the throughflow opening 15 and the process-valve duct 12 are largely mutually superimposed. The process valve is almost fully open.

A process valve of the type shown and of the use described is to be able to be activated in a controlled manner, on the one hand, and is also to contribute in terms of safety in that, in the case of a defect the former rapidly and reliably assumes a position which corresponds to a safe state. This safe state is presently a closed process valve.

According to the disclosure, the process valve is activated by a compact electrohydraulic system 20 which under water is disposed directly on the process valve 10. It suffices that only one electric cable 21 leads from the electrohydraulic system to the sea surface or to another superordinate electric control system that is located under water. The electrohydraulic system 20 shown as the exemplary embodiment has a vessel 22 which at an open side is fastened to the process-valve housing 11 such that an interior space 23 that is closed off in relation to the environment and is filled with a hydraulic fluid as an operating means is present. The vessel 22, in order to be fastened to the process-valve housing 11, has an internal flange at the open side thereof by way of which the former is screw-fitted to the process-valve housing. An encircling seal 16 which is placed into an encircling groove of the process-valve housing 11 is disposed radially outward of the screw connections, between the internal flange of the vessel 22 and the process-valve housing.

The vessel is pressure-compensated in relation to the ambient pressure prevailing under water. To this end, a lid 27 is fastened onto a flat periphery 25 having a flange 26 and surrounding an opening 24 in the vessel wall, and a membrane 28 is tightly jammed between the flat periphery 25 and the lid 27. Holes 29 are located in the lid 26 such that the space between the membrane and the lid is part of the environment and is filled with sea water. The interior space 23 is thus sealed off in relation to the environment by way of the membrane 28. The membrane, on the first face thereof that faces the interior space is impinged by the pressure in the interior space, and on the second face thereof that faces the lid 27 and is approximately of identical size as the first face, is impinged by the pressure that prevails in the environment, said membrane always seeking to assume a position and shape in which the sum of all forces acting thereon is zero. In order for the pressure in the interior space 23 to be slightly higher than the ambient pressure, the membrane 28, additionally to the ambient pressure, is also impinged counter to the internal pressure by a spring 30 which is clamp-fitted between a dimensionally stable and central membrane plate 31 and the lid 27. The force of the spring 30, while considering the size of the pressure-impinged faces of the membrane, is chosen such that the pressure in the interior space is 0.5 bar to 2 bar higher than the ambient pressure, for example. A rod 32 which is guided in the lid 27 and which may be provided with a dimensional standard and be part of a transducer which detects the position of the center of the membrane 28 is fastened to the membrane plate 31. A rod that is provided with a dimensional standard may also protrude from the membrane plate 31 into the interior space 23 so as to therein interact with a distance sensor. Contact with sea water is avoided in this instance, and the reliability is enhanced.

With the exception of the electric power source and of superordinate electric control signals, all mechanical, electrical, and hydraulic components which are required for or are advantageous to controlling the process valve 10 are accommodated in the interior space 23 of the vessel 22.

Here there is firstly a hydro-cylinder 35 having a cylinder housing 36 which at the end side is closed off by a cylinder base 37 and by a cylinder head 38, having a piston 39 that is displaceable in the interior of the cylinder housing 36 in the longitudinal direction of the cylinder housing, and having a piston rod 40 that is fixedly connected to the piston 39 and unilaterally protrudes from the piston 39 and that is sealed off and penetrates the cylinder head 38 in a guided manner that is not illustrated in more detail. The gap between the piston rod 40 and the cylinder head 38 is sealed by two seals 41 that are disposed in the cylinder head so as to be axially mutually spaced apart. The process-valve stem 14 is fastened to the free end of the piston rod 40. The interior of the cylinder housing 36 is subdivided by the piston 39 into a cylinder chamber 42 proximal to the base or else distal to the piston rod, and into a cylinder chamber 43 proximal to the piston rod, the volumes of said chambers depending on the position of the piston 39.

A helical compression spring 48 which surrounds the piston rod 40 and is clamp-fitted between the cylinder head 38 and the piston 39, that is to say impinges the piston in a direction in which the piston rod. 40 is retracted and the process-valve stem 14 is moved in order for the process valve 10 to be closed, is accommodated in the cylinder chamber 43.

A hydrostatic hydro-machine 50 which is operable as both as a pump as well as a hydro-motor, and an electro-machine 51 which for a conjointly rotating motion is mechanically coupled to the hydro-machine 50 and which is operable as both as an electric motor as well as a generator, are also located in the interior space 23 of the vessel 22. The hydro-machine 50 has a pressure connector 52 and a vacuum connector 53 which is open toward the interior space 23. The hydro-machine is readjustable from positive swept volumes via a zero position, in which the swept volume is zero, to negative swept volumes, such that said hydro-machine is operable as a pump and as a hydro-motor in the same rotation direction and by way of the same pressure connector. A positive swept volume herein is correlated with the operation as a pump. The electro-machine in terms of the revolution speed thereof is regulatable and to this end is connected to an electric control unit 54 which is likewise accommodated in the interior space 23 and by way of the cable 21 that is routed out of the vessel 22 in a sealed manner is connected to an electric power source on the sea surface or to a superordinate electric controller that is disposed under water. The revolution speed of the hydro-machine and of the electro-machine is detected by a revolution transmitter 55 and processed by the control unit 54.

Pressurized fluid that is suctioned from the interior space 23 during operation as a pump may be conveyed by the hydro-machine via the pressure connector 52 to the cylinder chamber 42. Conversely, pressurized fluid from the cylinder chamber 42 may be displaced by the hydro-machine 50 into the interior space 23 of the vessel 22. In this sense, the cylinder chamber 42 in the case of the exemplary embodiment is the first cylinder chamber. A 2-port/2-way seat valve 56 which in a resting position which the former assumes under the effect of a spring 57, is open, and in a switching position, to which said 2-port/2-way valve may be moved by an electromagnet 58, prevents flow of the pressurized means from the cylinder chamber 42 is inserted into the connection between the hydro-machine 50 and the cylinder chamber 42, so as to be located in the interior space 23.

Furthermore, a 2-port/2-way seat valve 60 which by way of one connector is connected to the second cylinder chamber 43 and by way of the other connector is open toward the interior space 23 is located in the interior space 23. The valve 60 under the effect of a spring 61 assumes a resting position in which the cylinder chamber 42 is blocked against an outflow of a pressurized means into the interior space 23, and said valve 60 by an electromagnet 62 may be moved to a switching position in which an open connection is established between the cylinder chamber 43 and the interior space 23.

A hydro-accumulator 65 having a cylindrical accumulator housing 66 which on the one end side is open toward the interior space 23 and on the other end side is closed off by way of a base 67, having an accumulator piston that is movable in the axial direction of the accumulator housing 66, and having a compression spring 69 which is clamp-fitted between the accumulator piston 68 and a detent on the open side of the accumulator housing 66 is also located in the interior space 23. A pressurized-fluid space 70 of which the volume depends on the position of the accumulator piston 68 is formed between the base 67 and the accumulator piston 68. The latter is thus impinged by a force that is generated by the pressure in the pressurized-fluid chamber 70 in the direction of an enlargement of the volume of the pressurized-fluid chamber 70, and in the opposite direction is impinged by a force that is generated by the pressure in the interior space 23 and by the force of the compression spring 69.

A pressurized means is infeedable from the hydro-machine 50 operating as a pump to the pressurized-fluid space 70 via a valve 75 that is located in the interior space 23. The valve 75 does not permit any flow of a pressurized means in the direction from the pressurized-fluid space 70 to the hydro-machine 50. Should the pressurized space be otherwise blocked, the accumulator piston 68 herein moves in the sense of an enlargement of the pressurized space, wherein the compression spring 69 is more intensely tensioned, the force of the compression spring is increased and, on account thereof, the accumulator pressure in the pressurized space is elevated so as to be above the pressure in the internal space 23. Because the characteristic curve of the spring 69 is known, each position of the accumulator piston 68 corresponds to a specific pressure in the pressurized-fluid space 70. A terminal position of the accumulator piston 68, and thus the desired maximum accumulator pressure, are detectable by way of a position encoder 71. The valve 75 is blocked once the maximum accumulator pressure has been reached, as is indicated by the dashed line that leads from the position encoder 71 to the valve 75. An electromechanical pressure sensor may also be used for detecting the accumulator pressure.

The pressurized-fluid space 70 of the hydro-accumulator 65 may be placed in fluidic communication with the second cylinder chamber 43 and be blocked in relation to the cylinder space 43 by way of a 2-port/2-way seat valve 76 that is located in the interior space 23. The valve 76 under the effect of a spring 77 assumes a resting position in which there is an open connection between the cylinder chamber 43 and the pressurized-fluid space 70, said valve 76 by an electromagnet 78 being able to the moved to a switching position in which the cylinder chamber 43 is blocked against any inflow of a pressurized means from the pressurized-fluid space 70.

The valves 56, 60, and 76 may be equipped with sensors for position monitoring, so as to immediately identify defective functioning by way of the electric control system.

The pressurized-fluid space 70 by way of a line 79 is connected to a region on the cylinder head 38 that lies axially between the two seals 41. Thus, in the case of a charged hydro-accumulator, the pressure differential at the external seal 41, specifically the differential between the pressure of the conveyed medium in the process valve that bears on the one side of the external seal 41, and the pressure on the other side of this seal is less than the differential between the pressure of the conveyed medium and the pressure in the interior space 23, such that the leakage is also reduced.

In terms of further valves present in the interior space 23, there are still a pressure-limiting valve 80 which is connected to the pressure connector 52 of the hydro-machine 50, and a suction valve 81 in the form of a stop valve that is disposed in the bypass between the vacuum connector 53 and the pressure connector 52 and that is open from the vacuum connector toward the pressure connector. Cavitation at the hydro-machine 50 is prevented by the suction valve 81, if and when the former is operated as a motor and the cylinder chamber has been completely emptied or the valve 56 closes.

In order for the process valve 10 to be able to be also operated manually by a robot such as by a remotely operated vehicle (ROV) or by an autonomous underwater vehicle (AUV), there is a manual interface 85 on the vessel 20, proceeding from which manual interface 85 a rod 86 enters through the base 67 into the cylinder chamber 43 and is coupled to the piston 39. The rod 86 in the interface 85 may have a movement thread, for example, and interact with an axially fixed screw nut that is provided with an internal thread, said screw nut being rotated in order to activate the process valve. The rod 86 in this instance is of course secured against inadvertent rotation. The means for manual activation are designed such that the tightness of the cylinder chamber 42 in relation to the interior space 23, and the tightness of the interior space 23 in relation to the environment, is guaranteed. The means for manual activation may also be designed such that a rod is connected to the piston of the hydro-cylinder by way of an idle stroke which permits the movement of the piston without entraining the rod. Only a simple thread between the rod and the nut is required in this instance. It has to be ensured herein that the rod is not readjusted in a self-acting manner since, in this instance, said rod would obstruct the movement of the piston. Finally, it is also conceivable for a switchable coupling to be disposed between the means for manual activation and the piston of the hydro-cylinder.

Additionally to the sensors already mentioned, there are also three position sensors 88 in the exemplary embodiment shown, by way of which specific positions of the piston 39 and thus of the piston rod 40 may be detected. There may also be only one sensor by way of which the positions of the piston 39 and of the piston rod 40 are continuously detected.

The device in FIG. 1 is shown in a state in which the process valve 10 is closed. The piston rod 40 of the hydro-cylinder 35 is fully retracted. The volume of the first cylinder chamber 42 is at a minimum; the volume of the second cylinder chamber 43 is at a maximum. The valves 56, 60, and 76 are located in the respective resting positions, that is to say that the valves 56 and 76 are open and the valve 60 is blocked. The same pressure prevails in the cylinder chamber 42 as in the interior space 23. The same pressure prevails in the cylinder chamber 43 as in the pressurized-fluid space 70 of the accumulator.

Figure 2:
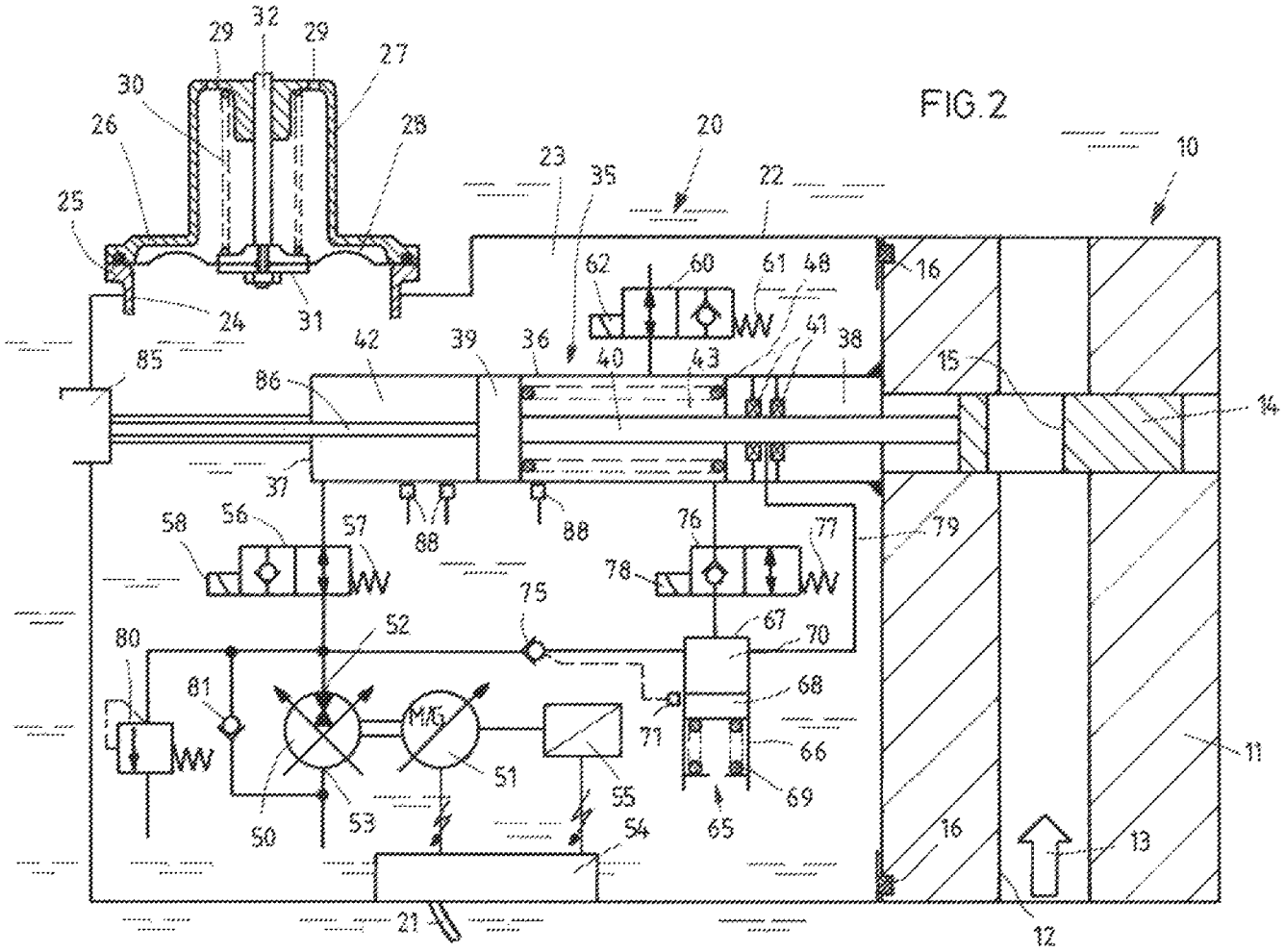
FIG. 2 schematically shows the device in the case of an almost fully open process valve.

The valves 60 and 76 are switched to the switched positions shown in FIG. 2 in order for the process valve to be opened, such that the cylinder chamber 43 is separated from the pressurized-fluid space 70 of the hydro-accumulator 65 and is connected to the interior space 23. The hydro-machine 50 is set to a positive swept volume and, as a pump driven by the electro-machine 51 operating as an electric motor, conveys a pressurized means. The load pressure in the first cylinder chamber 42 is determined by the force of the helical compression spring 48 and by the force with which the process-valve stem. 14 counteracts any movement. Should the load pressure initially be lower than the accumulator pressure, the piston, after a pressurized means has been conveyed by the hydro-machine 50, immediately begins to move in a first direction which in the exemplary embodiment corresponds to a deployment, wherein the term "immediately" as used herein may disregard that amount of pressurized means that is required for compressing of the pressurized means. As the tension of the helical compression spring 48 increases, the load pressure increases and finally is equal to the accumulator pressure. Should the load pressure initially be higher than the accumulator pressure, only the hydro-accumulator 65 is thus initially filled by way of the valve 75, until the accumulator pressure is equal to the load pressure. The piston 39, and conjointly therewith the piston rod 40, are then moved upon pressurized means being further conveyed by the hydro-machine 50, and the hydro-accumulator 65 is simultaneously filled. The valve 75 closes once the accumulator pressure reaches the maximum value. The volume of the second cylinder chamber 43 is reduced during the movement of the piston. A pressurized means is displaced from the cylinder chamber 43 via the valve 60 into the interior space 23 of the vessel 22.

The valve 56 is switched and thus closed should the process-valve stem 14 have reached the desired position, for example the position shown in FIG. 2. The hydro-machine 53 is brought to a stop, so as to save energy. The first cylinder chamber 42 is blocked by the valve 56 such that the position of the process-valve stem is maintained. The valves 60 and 76 remain in the switched positions shown in FIG. 2.

A volume in the vessel 22 that previously was occupied by the plunging portion of the piston rod 40 is now vacated by the piston rod 40 plunging into the process-valve housing 11. The membrane 28 will therefore move inward into the vessel while the piston rod is being deployed, without any leakage having arisen. The respective path has to be considered if and when any leakage is to be detected by a position sensor for the membrane.

In order for the process-valve stem 14 to be moved in a controlled manner in the closing direction, the valve 56 is moved to the resting position thereof, and the hydro-machine is set to a negative swept volume, or in the case of a positive swept volume of the hydro-machine 50 the rotation direction of the electro-machine 51 is reversed so as to be counter to the rotation direction when deploying the piston rod 40. The speed at which the process-valve stem 14 is moved under the effect of the helical compression spring 48 is determined by the revolution speed and by the swept volume of the hydro-machine 50, now operating as a hydro-motor, and by the electro-machine 51, operating as a generator. A pressurized means is suctioned from the interior space 23 into the enlarging cylinder chamber 43 during the retracting motion.

There are situations in which the process valve is to be moved rapidly from an open position to a closed position. Such a situation may prevail in the case of an outage of the electric power supply, for example. In the case of an outage of the electric power supply the valves 56, 60, and 76 under the effect of the springs 57, 61, and 77 move to the respective resting position. The hydro-machine is set to the maximum positive swept volume. The first cylinder space 42 is open toward the hydro-machine 50 in the resting position of the valve 56. In the resting positions of the valves 60 and 76 the cylinder space 43 is blocked in relation to the interior space 23 and is open toward the pressurized-fluid space 70 of the hydro-accumulator 65, and is therefore impinged by an accumulator pressure that acts on an annular face of the piston 39. The latter, conjointly with the piston rod 40, is now moved in a second direction that is counter to the first direction. The piston rod is retracted, and the process valve 10 is closed. This happens very rapidly, because a pressure force is also acting additionally to the force of the helical compression spring 48.

Should the spring force be absent due to a breakage of the helical compression spring 48, the process valve may also be closed just by infeeding a pressurized means from the hydro-accumulator 65 to the cylinder chamber 43.

Finally, manual activation of the process valve by way of the interface 85 is also possible by a robot.

Modifications to an electrohydraulic system according to the disclosure are also possible, as compared with the exemplary embodiment shown.

The electric control system in the simplest form comprises a DC motor, an electric control apparatus having respective analog and digital input and output interfaces, and a suitable power supply.

The electric control system in an advanced form comprises a polyphase motor having a respective drive and a frequency inverter, an electric control apparatus having respective analog and digital input and output interfaces, and a suitable power supply, and network interfaces, i.e. a LAN, bus systems, as well as fiber-optic cables or a wireless LAN.

The electric cable, apart from the voltage supply, also comprises the electric signals for controls communications, such as nominal values, actual values, and error messages.

Monitoring of the state (condition monitoring) of the electrohydraulic system is implementable in the electric control system in that all sensors signals are evaluated by way of respective algorithms that are implemented in the form of software. In the case of an incident the control system may autonomously move the hydro-cylinder to the safe resting position and inform the superordinate control system. To this end, preventive and reactive maintenance measures may be communicated to the superordinate control system.

The vessel may have an interface at which hydraulic fluid may be replenished by a robot if this should be required by virtue of a preceding leakage.

The hydro-cylinder 35 in the exemplary embodiment shown is received in the vessel 22. However, solutions in which the hydro-cylinder is located outside the vessel and is fastened to the process valve are also conceivable. The vessel in this instance may be fastened to the hydro-cylinder or to the process valve.

LIST OF REFERENCE SIGNS

10 Process valve
11 Process-valve housing
12 Process-valve duct
13 Arrow
14 Process-valve stem
15 Throughflow opening
20 Electrohydraulic system
21 Cable
22 Vessel
23 Interior space of 22
24 Opening in 22
25 Flat periphery
26 Flange
27 Lid
28 Membrane
29 Holes in 27
30 Spring
31 Membrane plate
32 Rod
35 Hydro-cylinder
36 Cylinder housing
37 Cylinder base
38 Cylinder head
39 Piston
40 Piston rod
41 Seals
42 Cylinder chamber
43 Cylinder chamber
48 Helical compression spring
50 Hydro-machine
51 Electro-machine
52 Pressure connector
53 Vacuum connector
54 Electric control unit
55 Revolution transmitter
56 2-port/2-way seat valve
57 Spring
58 Electromagnets
60 2-port/2-way seat valve
61 Spring
62 Electromagnets
65 Hydro-accumulator
66 Accumulator housing
67 Base
68 Accumulator piston
69 Compression spring
70 Pressurized-fluid space
75 Valve
76 2-port/2-way seat valve
77 Spring
78 Electromagnets
79 Line
80 Pressure-limiting valve
81 Suction valve
85 Manual interface
86 Rod
88 Position sensor

The invention claimed is:

1. An electrohydraulic system for use under water, comprising:

a vessel having an interior space configured to (i) form a volume that is closed off in relation to the environment and (ii) receive a hydraulic fluid, the vessel including a compensation piston configured to pressurize the hydraulic fluid in the interior space to at least approximately that pressure that prevails in the environment;

a hydrostatic machine that is operable at least as a pump; and an electro-machine that is mechanically coupled to the hydrostatic machine and operates as an electric motor configured to operate the hydrostatic machine as the pump, wherein the hydrostatic machine and the electro-machine are disposed in the interior space of the vessel, and wherein a first connection between a pressure connector of the hydrostatic machine and a first consumer line configured to supply a first pressurized space of a hydraulic consumer is controllable by way of a first valve that is located in the interior space of the vessel in such a manner that the connection (i) in a resting position which the first valve assumes under the effect of a spring is open, and (ii) in a switching position which the first valve assumes under the effect of an electric actuator is blocked at least in the direction from a first cylinder chamber to the hydrostatic machine.

2. The electrohydraulic system as claimed in claim 1, wherein the hydrostatic machine is also operable as a hydro-motor, and the electro-machine is also operable as a generator.

3. The electrohydraulic system as claimed in claim 1, wherein the hydrostatic machine has an adjustable swept volume.

4. The electrohydraulic system as claimed in claim 3, wherein the hydrostatic machine is readjustable from positive swept volumes via a zero position in which the swept volume is zero to negative swept volumes, such that the hydrostatic machine is operable as the pump and as a motor in a single rotation direction and by way of a single pressure connector.

5. The electrohydraulic system as claimed in claim 1, wherein the electro-machine is regulatable in terms of a revolution speed of the electro-machine.

6. The electrohydraulic system as claimed in claim 1, further comprising:

a hydro-accumulator arranged in the interior space of the vessel and defining a pressurized-fluid space, the hydro-accumulator being configured to receive pressurized fluid from the hydrostatic machine in the operation of the hydrostatic machine as the pump, and configured such that pressurized fluid is fed from the hydro-accumulator to a second consumer line configured to supply a pressurized space of the hydraulic consumer.

7. The electrohydraulic system as claimed in claim 6, wherein a second connection between the second consumer line and the pressurized-fluid space of the hydro-accumulator is controllable by a second valve that is located in the interior space of the vessel, the second valve having (i) a resting position in which the second valve is biased into an open position by a spring, and (ii) a switching position in which the second valve is actuated by an electric actuator into a closed position in which the second connection is blocked at least in a direction from the hydro-accumulator to the pressurized space.

8. The electrohydraulic system as claimed in claim 7, wherein a third connection between the interior space of the vessel and the second consumer line is controllable by a third valve that is located in the interior space of the vessel, the third valve having (i) a resting position in which the valve is biased by a spring i-s into a closed position in which the third connection is blocked at least in the direction from the pressurized space to the interior space, and (ii) a switching position in which the third valve is actuated into an open position.

9. The electrohydraulic system as claimed in claim 1, wherein:

the hydraulic consumer includes a hydro-cylinder positioned in the interior space of the vessel and having an interior that is subdivided into a second cylinder chamber proximal to a piston rod, and into the first cylinder chamber distal to the piston rod by way of a piston to which the piston rod is connected, in order for the piston rod to be moved in a first direction, pressurized fluid is fed from the hydrostatic machine operating as the pump to one of the first and second cylinder chambers.

10. The electrohydraulic system as claimed in claim 9, wherein the hydro-cylinder comprises a mechanical spring assembly by which the piston is biased in a second direction that is counter to the first direction.

11. The electrohydraulic system as claimed in claim 9, further comprising:

a hydro-accumulator arranged in the interior space of the vessel and defining a pressurized-fluid space, the hydro-accumulator being configured to receive pressurized fluid from the hydrostatic machine in the operation of the hydrostatic machine as the pump, and configured such that pressurized fluid is fed from the hydro-accumulator to a consumer line configured to supply a pressurized space of the hydro-cylinder, two seals surrounding the piston rod in an axially sequential manner in a cylinder head of the hydro-cylinder that guides the piston rod, and a region between the two seals is in fluidic communication with the pressurized-fluid space of the hydro-accumulator.

12. The device as claimed in claim 9, wherein moving the piston rod in the first direction deploys the piston rod, and wherein the first cylinder chamber is the cylinder chamber distal to the piston rod.

13. The electrohydraulic system as claimed in claim 1, wherein a first face of the compensation piston is acted on by the pressure in the interior space of the vessel, and a second face of the compensation piston, which is of identical size to and opposite to the first face, is acted on by the ambient pressure and by a spring assembly which generates a spring force that is directed in the same direction as the force which is generated by the ambient pressure.

14. The electrohydraulic system as claimed in claim 13, wherein a position of the compensation piston is detectable by a position sensor.

15. The electrohydraulic system as claimed in claim 1, wherein the pressure connector of the hydrostatic machine is secured by a pressure-limiting valve.

16. A device for disposing under water and for controlling a volumetric flow of a gaseous or liquid medium, comprising:

a process valve having a process-valve housing;

a process-valve stem configured to control the volumetric flow;

a hydro-cylinder fastened to the process-valve housing, the hydro-cylinder configured to move the process-valve stem; and an electrohydraulic system, including:

a vessel having an interior space configured to (i) form a volume that is closed off in relation to the environment and (ii) receive a hydraulic fluid, the vessel including a compensation piston configured to pressurize the hydraulic fluid in the interior space to at least approximately that pressure that prevails in the environment, a hydrostatic machine that is operable at least as a pump, and an electro-machine that is mechanically coupled to the hydrostatic machine and operates as an electric motor configured to operate the hydrostatic machine as the pump, the hydrostatic machine and the electro-machine disposed in the interior space of the vessel, wherein the vessel is fastened in a sealed manner to the process-valve housing, and wherein a connection between a pressure connector of the hydrostatic machine and a consumer line configured to supply a pressurized space of a hydraulic consumer is controllable by way of a valve that is located in the interior space of the vessel in such a manner that the connection (i) in a resting position which the valve assumes under the effect of a spring is open, and (ii) in a switching position which the valve assumes under the effect of an electric actuator is blocked at least in the direction from a first cylinder chamber to the hydrostatic machine.

17. The device as claimed in claim 16, wherein the hydro-cylinder protrudes into the interior space of the vessel through an opening in the interior space.

* * * * *